US007406907B1

(12) United States Patent
Goon et al.

(10) Patent No.: US 7,406,907 B1
(45) Date of Patent: Aug. 5, 2008

(54) COUPLING FOR CONNECTING AMMUNITION CARTRIDGE LOOPS

(75) Inventors: Eric Goon, Mountain Lakes, NJ (US); Stojan Kotefski, Bloomingdale, NJ (US); Robert Kowalski, Verona, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/163,578

(22) Filed: Oct. 24, 2005

Related U.S. Application Data

(60) Provisional application No. 60/522,792, filed on Nov. 8, 2004.

(51) Int. Cl.
*F41A 9/29* (2006.01)
*F42B 39/08* (2006.01)

(52) U.S. Cl. ..... 89/34; 89/35.01

(58) Field of Classification Search ..... 89/34, 89/35.01, 35.02; 42/87–89; 24/2.5; 59/2, 59/11

See application file for complete search history.

(56) References Cited

U.S. PATENT DOCUMENTS

| | | | | | |
|---|---|---|---|---|---|
| 3,112,673 | A * | 12/1963 | Sarvis | 89/35.01 |
| 3,182,556 | A * | 5/1965 | Rocha | 89/35.02 |
| 3,190,179 | A * | 6/1965 | Benoit | 89/35.02 |
| 3,253,512 | A * | 5/1966 | Schallehn | 89/35.02 |
| 3,254,565 | A * | 6/1966 | La Fever et al. | 89/35.02 |
| 3,377,919 | A * | 4/1968 | Clark | 89/35.02 |
| 3,465,640 | A * | 9/1969 | Sarvis | 89/35.02 |
| 4,011,788 | A * | 3/1977 | Reed | 89/33.2 |
| 5,398,590 | A * | 3/1995 | Snyder, Sr. | 89/33.16 |
| 5,546,845 | A * | 8/1996 | Wossner et al. | 89/35.01 |
| 6,430,861 | B1 * | 8/2002 | Ayers et al. | 42/84 |

* cited by examiner

*Primary Examiner*—Bret Hayes
(74) *Attorney, Agent, or Firm*—John F. Moran

(57) ABSTRACT

An apparatus comprising a cartridge loop, the cartridge loop having a coupling interface with an opening defined in part by a pair of substantially parallel lines separated by a distance; and a coupling comprising first and second ends and a link that connects the first and second ends, the first end connecting with the coupling interface of the cartridge loop wherein a portion of the link adjacent the first end has a first thickness that is greater than the distance between the substantially parallel lines and a second thickness that is less than the distance between the substantially parallel lines.

15 Claims, 5 Drawing Sheets

COUPLING FOR CONNECTING AMMUNITION CARTRIDGE LOOPS

CROSS-REFERENCE TO RELATED APPLICATIONS

This application claims the benefit under 35 USC 119(e) of U.S. provisional patent application 60/552,792 filed on Nov. 8, 2004, the entire file wrapper contents of which provisional application are herein incorporated by reference as though fully set forth at length.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to apparatus for transporting ammunition cartridges through a gun firing system and, in particular, to a transport apparatus that uses loops and couplings.

To convey ammunition cartridges, for example, 40 mm cartridges, through a weapon, a transport means is necessary to position and guide the cartridges through the gun firing system. The transport means may include couplings and loops. The cartridges are positioned in the loops and the couplings link the loops together. A plurality of cartridges and loops are connected together by the couplings to form an ammunition belt. The couplings and loops are physically shocked, pulled and distorted throughout the firing cycle and, therefore, require a certain strength to function properly.

Known ammunition belts are packaged for the specific end user in belt sizes with typically 32 or 94 rounds. However, there is no means for disconnecting or connecting (or assembling or disassembling) any ammunition cartridges from the original belt. An easy-to-use connect/disconnect feature is needed. For example, splicing partial belts into full belts, switching from one belt type to another (i.e., 32 round belt to 94 round belt) and assembling various size belts at the factory would all be easier with a connect/disconnect feature.

The loading of a new belt onto a weapon is time consuming and exposes the user to hostile fire during the belt re-loading stage. Perhaps the most important advantage of a connect/disconnect feature is the ability to connect additional belts to an already loaded belt of ammunition. It would be much easier and safer for a soldier under fire to simply connect additional belts to an already loaded belt, rather than having to reload each belt onto the weapon. Furthermore, in the past, partially used belts with only a few rounds have been discarded. With a connect/disconnect feature, the partially used belts can be connected together and used, thereby eliminating wasted ammunition and the problem of disposing of live, discarded ammunition.

SUMMARY OF THE INVENTION

It is an object of the invention to provide an ammunition belt that is easily connected to and disconnected from other ammunition belts.

Another object of the invention is to provide a loop and coupling type transport apparatus for ammunition cartridges wherein adjacent ammunition cartridges can be easily and quickly connected or disconnected.

A further object of the invention is to provide an ammunition cartridge transport apparatus that saves ammunition by allowing partially used belts of ammunition to be connected together.

Yet another object of the invention is to provide a coupling for a loop and coupling type ammunition cartridge transport apparatus wherein the coupling is rotatable from a locked position to an unlocked position.

Still another object of the invention is to provide a coupling that can be used with existing cartridge loops.

One aspect of the invention is an apparatus comprising a cartridge loop, the cartridge loop having a coupling interface with an opening defined in part by a pair of substantially parallel lines separated by a distance; and a coupling comprising first and second ends and a link that connects the first and second ends, the first end connecting with the coupling interface of the cartridge loop wherein a portion of the link adjacent the first end has a first thickness that is greater than the distance between the substantially parallel lines and a second thickness that is less than the distance between the substantially parallel lines.

Preferably, a cross-section of the portion of the link comprises a second pair of substantially parallel lines separated by the second thickness. The apparatus may further comprise a second cartridge loop having a coupling support that connects with the second end of the coupling.

In a preferred embodiment, the first end of the coupling comprises a locking head with four sides and the coupling interface comprises a front wall and two side walls disposed on opposite sides of the front wall, the opening of the coupling interface being defined in the front wall and the locking head being disposed between the side walls. Advantageously, a diagonal of the locking head has a length such that the diagonal forms an interference fit with the side walls.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
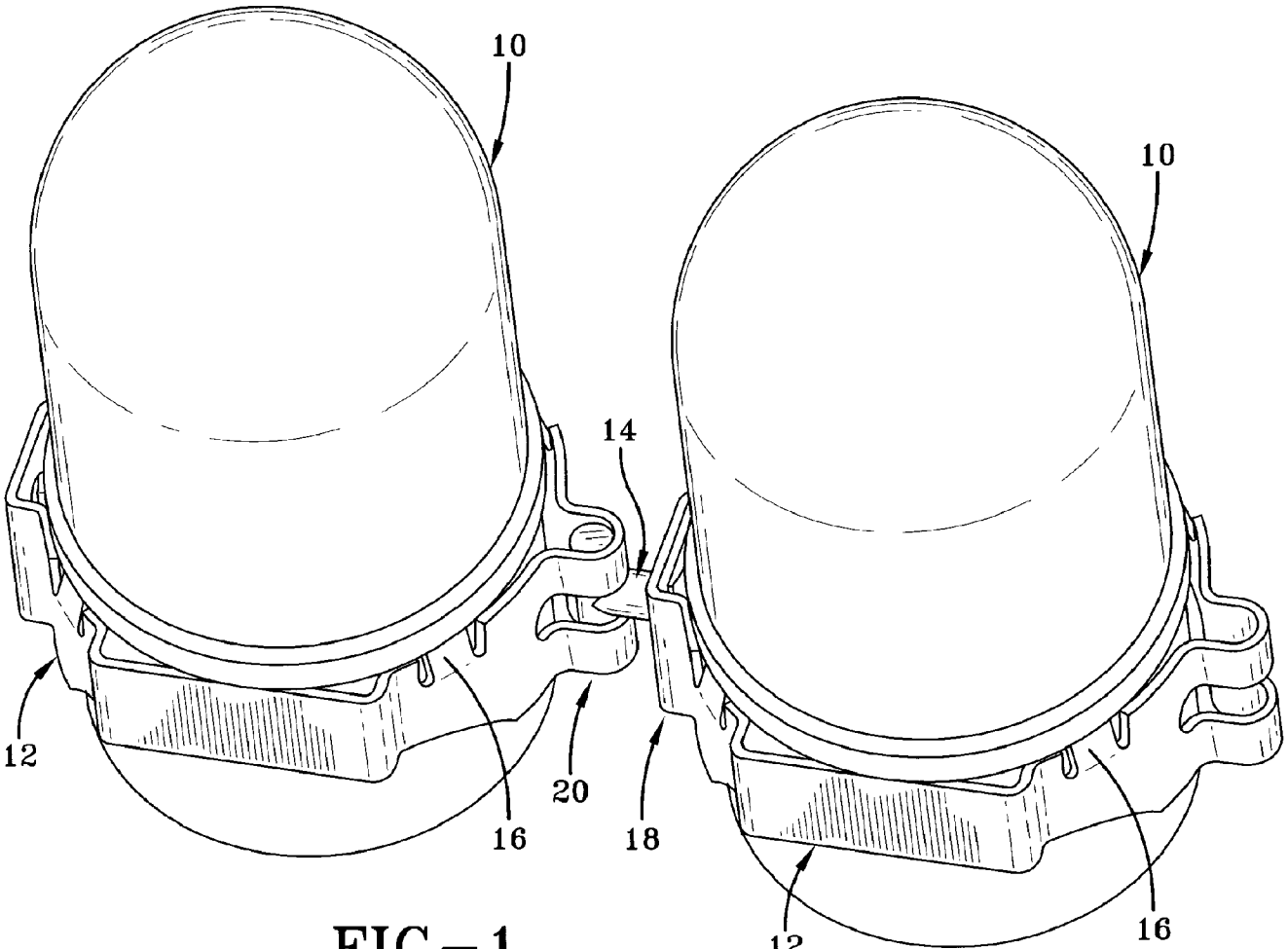
FIG. 1 is a perspective view of cartridges disposed in loops according to the invention.

FIG. 1 shows two cartridges 10 disposed in loops 12 that are connected by a coupling 14. Although the detailed geometric shape of coupling 14 is not readily apparent in FIG. 1, it will be fully described later in connection with the discussion of FIGS. 5A-5C. An ammunition belt comprises a plurality of these cartridges 10 disposed in loops 12 that are connected by couplings 14. For example, a 32 round belt will have 32 cartridges disposed in 32 loops that are connected together with couplings.

Figure 2:
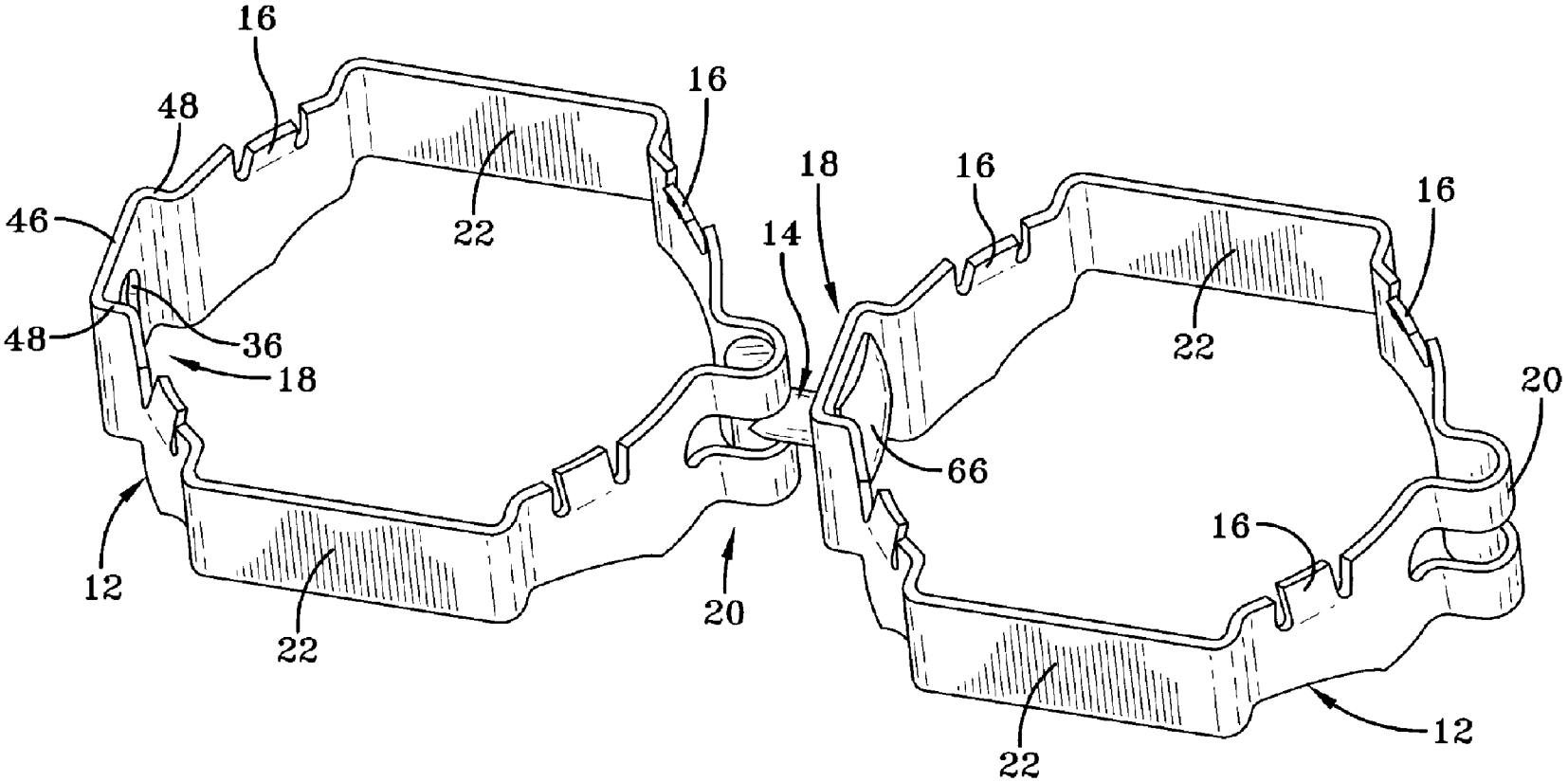
FIG. 2 shows the loops of FIG. 1 without the cartridges.

FIG. 2 shows two loops 12 without the cartridges 10. Locking tabs 16 on the loops 12 help position the cartridges 10 in the loops 12. As shown in FIG. 2, loop 12 includes side members 22, a coupling support 20 on one end and a coupling interface 18 on another end. Coupling 14 connects the coupling support 20 of one loop 12 to the coupling interface 18 of another loop 12.

Figure 3C:
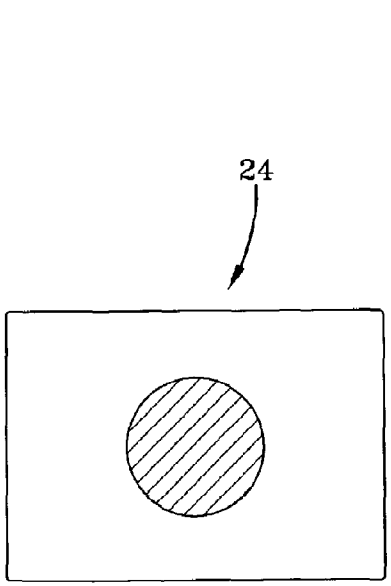
FIG-3C PRIOR ART
FIG. 3C is a sectional view along the line 3C-3C of FIG. 3A.
Figure 3A:
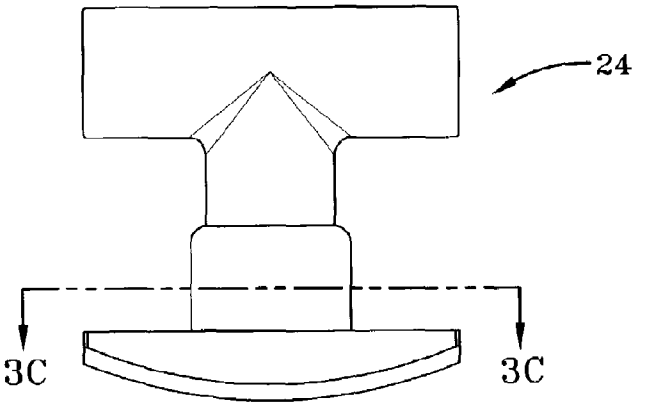
FIG-3A PRIOR ART
FIG. 3A is a top view of a prior art coupling.
Figure 3B:
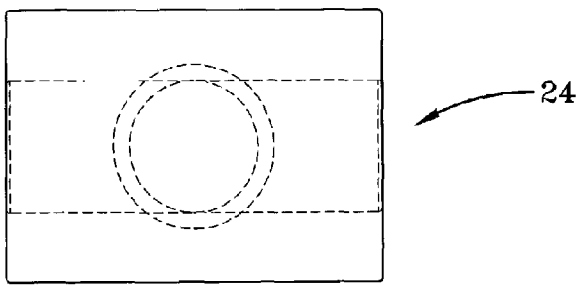
FIG-3B PRIOR ART
FIG. 3B is an end view of FIG. 3A.

FIG. 3A is a top view of a prior art coupling 24. FIG. 3B is an end view of FIG. 3A. FIG. 3C is a sectional view along the line 3C-3C of FIG. 3A. With the prior art coupling 24, once the cartridge 10 is loaded into the loop 12, it is not possible to disconnect the known coupling 24 from either the coupling support 20 or the coupling interface 18. In addition, the known coupling 24 cannot be used to connect two loops 12 that are loaded with cartridges 10. The principle problem that the present invention solves is the inability to connect or disconnect loaded loops 12 using the known coupling 24. Thus, the present invention is directed to a novel coupling 14 that can connect two loaded loops 12 or disconnect two loaded loops 12.

Figure 4A:
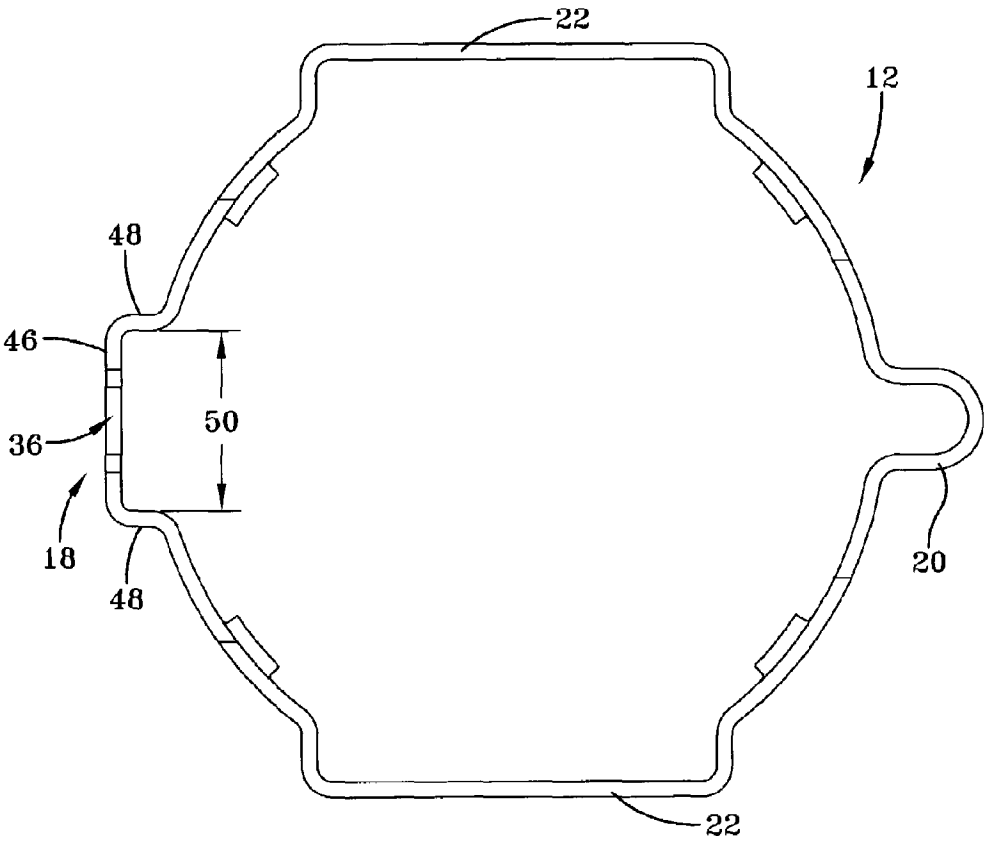
FIG. 4A is a bottom view of a cartridge loop 12.
Figure 4B:
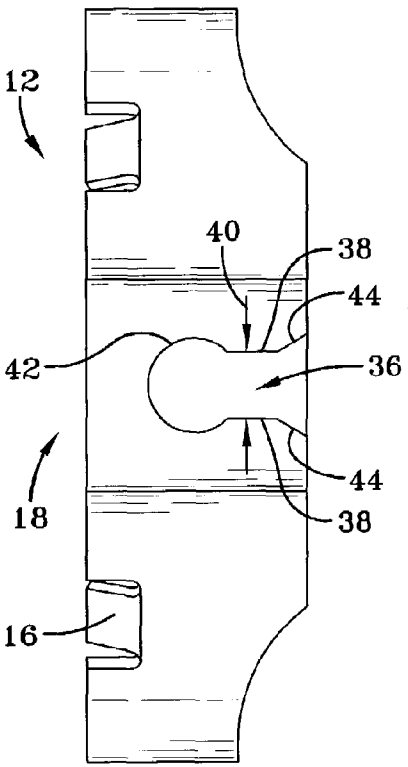
FIG. 4B is a side view of FIG. 4A.

FIG. 4A is a bottom view of a cartridge loop 12. FIG. 4B is a side view of FIG. 4A. Cartridge loop 12 has a coupling interface 18 with an opening 36 defined in part by a pair of substantially parallel lines 38 separated by a distance 40. Opening 36 may be further defined by a curved portion 42 connected to one end of the parallel lines 38 and a pair of diverging lines 44 connected to another end of the parallel lines 38. The coupling interface 18 comprises a front wall 46 and two side walls 48 disposed on opposite sides of the front wall 46. The opening 36 of the coupling interface 18 is defined in the front wall 46. A distance 50 separates the side walls 48.

Figure 5A:
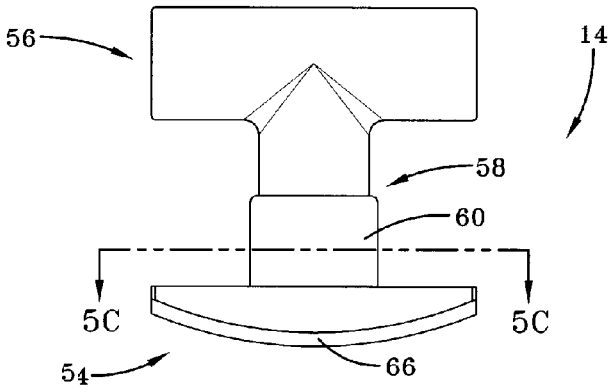
FIG. 5A is a detailed top view of one embodiment of a coupling in accordance with the invention.
Figure 5B:
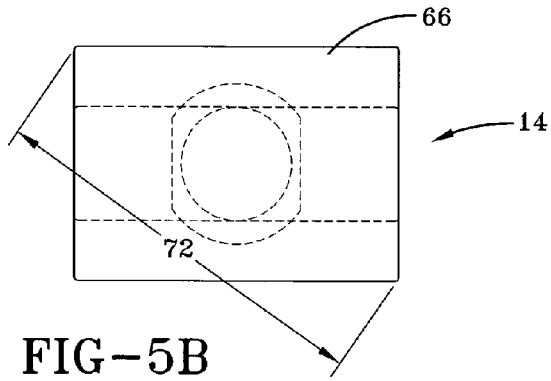
FIG. 5B is a detailed end view of FIG. 5A.
Figure 5C:
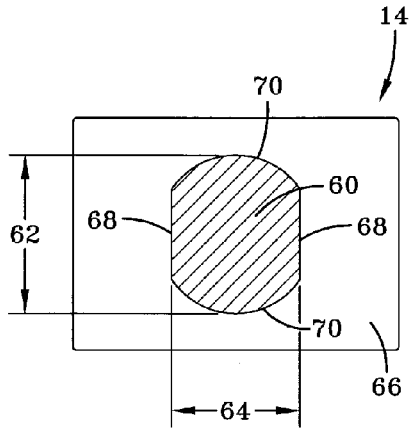
FIG. 5C is a detailed sectional view along the line 5C-5C of FIG. 5A.

FIG. 5A is a top view of one embodiment of a coupling 14 in accordance with the invention. FIG. 5B is an end view of FIG. 5A. FIG. 5C is a sectional view along the line 5C-5C of FIG. 5A. Coupling 14 comprises first and second ends 54, 56 and a link 58 that connects the first and second ends 54, 56. The first end 54 connects with the coupling interface 18 of the cartridge loop 12. The second end 56 connects with the coupling support 20 of an adjacent loop 12.

A portion 60 (FIG. 5C) of the link 58 adjacent the first end 54 has a thickness 62 that is greater than the distance 40 between the substantially parallel lines 38 (FIG. 4B) and a thickness 64 that is less than the distance 40 between the substantially parallel lines 38. The thickness 62 and the thickness 64 are measured orthogonal to each other. A cross-section (FIG. 5C) of the portion 60 of the link 58 comprises a pair of substantially parallel lines 68 separated by the thickness 64. The cross-section of the portion 60 of the link 58 may also include a pair of arcs 70 connected to ends of the pair of substantially parallel lines 68, respectively. The thickness 62 corresponds to the longest distance between the pair of arcs 70.

The first end 54 of the coupling 14 also comprises a locking head 66 with four sides, as best seen in FIGS. 5B and 5C. The locking head 66 is disposed between the side walls 48 (FIG. 4A) of the coupling interface 18. The diagonal of the locking head 66 has a length 72 such that, when rotated, the locking head 66 forms an interference fit with the side walls 48 that are a distance 50 apart. The interference fit allows a person, by applying a twisting torque to adjacent cartridges 10, to rotate the locking head 66 within the side walls 48, but prevents the locking head 66 from rotating freely within the side walls 48.

During rotation of the locking head 66, a snapping force is generated in the loop 12. As the locking head 66 is rotated within the side walls 48, the locking head 66 interferes with the side walls 48, causing the side walls 48 to deform slightly outwards. As the ninety degree rotation continues and the diagonal of the locking head 66 no longer contacts the side walls 48, the side walls 48 snap back and help lock the locking head 66 in position. This locking action maintains the characteristics of the known ammunition belt when exposed to the weapon firing forces.

Three features of the invention are very important for proper functioning. First, the thickness 62 of the portion 60 (FIG. 5C) of the link 58 adjacent the first end 54 is greater than the distance 40 between the substantially parallel lines 38 (FIG. 4B) of the opening 36 of the coupling interface 18. When the coupling 14 is in a locked position, the thickness 62 prevents the coupling 14 from sliding out of the opening 36.

Second, the thickness 64 of the portion 60 (FIG. 5C) of the link 58 adjacent the first end 54 is less than the distance 40 between the substantially parallel lines 38 of the opening 36. When the coupling 14 is in an unlocked position, the thickness 64 allows the coupling 14 to slide out of the open end of the opening 36 between the diverging lines 72.

Third, the length 72 of the diagonal of the locking head 66 is such that the diagonal forms an interference fit between the side walls 48 (spaced apart by a distance 50) of the coupling interface 18. Thus, the coupling 14 may be rotated ninety degrees from a locked position to an unlocked position and vice versa.

The embodiment of the novel coupling 14 that is shown is the preferred embodiment, because that embodiment can be produced with a minimum of modification to the existing tooling. However, the invention is not limited to the embodiment shown. As long as the coupling 14 has the three important features noted above, it should be able to function satisfactorily. Thus, various features of the coupling 14 and the loop 12, such as the opening 36 in the coupling interface 18 and the first end 54, second end 56 and link 58 of the coupling 14 may, in other embodiments of the invention, comprise geometrical shapes that differ from the specific shapes shown.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus, comprising:

a cartridge loop, the cartridge loop having a coupling interface with an opening defined in part by a pair of substantially parallel lines separated by a distance; and a coupling comprising first and second ends and a link that connects the first and second ends, the first end connecting with the coupling interface of the cartridge loop wherein a portion of the link adjacent the first end has a first thickness that is greater than the distance between the substantially parallel lines and the portion having a second thickness that is less than the distance between the substantially parallel lines wherein the first thickness and the second thickness are measured orthogonal to each other.

2. The apparatus of claim 1 wherein a cross-section of the portion of the link comprises a second pair of substantially parallel lines separated by the second thickness.

3. The apparatus of claim 2 wherein the cross-section of the portion of the link comprises a pair of arcs connected to ends of the second pair of substantially parallel lines, respectively, and further wherein the first thickness corresponds to a longest distance between the pair of arcs.

4. The apparatus of claim 1 further comprising a second cartridge loop having a coupling support that connects with the second end of the coupling.

5. The apparatus of claim 4 further comprising cartridges disposed in the cartridge loop and the second cartridge loop.

6. The apparatus of claim 5 wherein the cartridges are 40 mm cartridges.

7. The apparatus of claim 1 wherein the first end of the coupling comprises a locking head with four sides and the coupling interface comprises a front wall and two side walls disposed on opposite sides of the front wall, the opening of the coupling interface being defined in the front wall and the locking head being disposed between the side walls.

8. The apparatus of claim 7 wherein a diagonal of the locking head has a length such that the diagonal forms an interference fit with the side walls.

9. A coupling for a cartridge loop having a coupling interface, the coupling interface having an opening defined in part by a pair of substantially parallel lines separated by a distance, comprising:

first and second ends and a link that connects the first and second ends, the first end connecting with the coupling interface of the cartridge loop wherein a portion of the link adjacent the first end has a first thickness that is greater than the distance between the substantially parallel lines and the portion having a second thickness that is less than the distance between the substantially parallel lines wherein the first thickness and the second thickness are measured orthogonal to each other.

10. The apparatus of claim 9 wherein a cross-section of the portion of the link comprises a second pair of substantially parallel lines separated by the second thickness.

11. The apparatus of claim 10 wherein the cross-section of the portion of the link comprises a pair of arcs connected to ends of the second pair of substantially parallel lines, respectively, and further wherein the first thickness corresponds to a longest distance between the pair of arcs.

12. The apparatus of claim 11 further comprising a cartridge disposed in the cartridge loop.

13. The apparatus of claim 12 wherein the cartridge is a 40 mm cartridge.

14. The apparatus of claim 9 wherein the first end of the coupling comprises a locking head with four sides and the coupling interface comprises a front wall and two side walls disposed on opposite sides of the front wall, the opening of the coupling interface being defined in the front wall and the locking head being disposed between the side walls.

15. The apparatus of claim 14 wherein a diagonal of the locking head has a length such that the diagonal forms an interference fit with the side walls.

* * * * *